US005219448A

United States Patent [19]

Hackmann

[11] Patent Number: 5,219,448

[45] Date of Patent: Jun. 15, 1993

[54] OINTMENT APPLICATOR

[75] Inventor: Ludger Hackmann, Lohne/Oldenburg, Fed. Rep. of Germany

[73] Assignee: Bramlage Gesellschaft mit beschränkter Haftung, Lohne/Oldenburg, Fed. Rep. of Germany

[21] Appl. No.: 677,142

[22] Filed: Dec. 3, 1984

[30] Foreign Application Priority Data

Nov. 14, 1984 [DE] Fed. Rep. of Germany ..... 3441609

[51] Int. Cl.[5] ..... A61M 3/00; B05C 17/00

[52] U.S. Cl. ..... 401/176; 401/133; 401/182; 604/232

[58] Field of Search ..... 401/132-135, 401/172, 176, 182; 604/232

[56] References Cited

U.S. PATENT DOCUMENTS 4,405,249 9/1983 Scales ..... 401/182 X
4,599,008 7/1986 Furlong et al. ..... 401/182 X
4,643,724 2/1987 Jobe ..... 604/232

*Primary Examiner*—Steven A. Bratlie
*Attorney, Agent, or Firm*—Martin A. Farber

[57] ABSTRACT

According to the invention the packing container, which is shaped as a cartridge (1) having diverging wall openings (5), has at its rear end, which is equipped with a collar (4) for insertion in an application handle (A), an insertion region of larger cross section for a piston (10) which is adapted to the front smaller cross section of the cartridge, with an air-pervious perforation contact between piston sealing surface and inner wall of the region (9) of larger cross section, the end of which region is closed by a membrane (15) which can be pierced by a piston rod (16) of the application handle (A).

12 Claims, 1 Drawing Sheet

OINTMENT APPLICATOR

FIELD AND BACKGROUND OF THE INVENTION

The present invention relates to an ointment applicator with a package container which contains the ointment and can be emptied by pressure actuation.

The object of the invention is to develop an ointment applicator together with a package container in a favorable manner and with respect to its structure, assembly and use, hygienic conditions being in particular taken into optimum account.

SUMMARY OF THE INVENTION

According to the invention the packing container, which is shaped as a cartridge (1) having diverging wall openings (5), has at its rear end, which is equipped with a collar (4) for insertion in an application handle (A), an insertion region of larger cross section for a piston (10) which is adapted to the front smaller cross section of the cartridge, with an air-previous perforation contact between piston sealing surface and inner wall of the region (9) of larger cross section, the end of which region is closed by a membrane (15) which can be pierced by a piston rod (16) of the application handle (A).

As a result of this development, an ointment applicator is created which, while being easily operated, can be used properly even by a layman. The target point, for instance the zone of the painful anoderm, is fully covered as a result of the diverging wall openings. Furthermore, the package container, which is developed as a cartridge, can be easily and conveniently introduced and the empty cartridge can be easily and conveniently removed. A collar which creates the corresponding connecting region can be formed without particular expense on the free end of the cartridge. Such a collar furthermore stabilizes the insertion region; the wall of the cartridge can be kept very thin. Furthermore, a piston assembly with venting is provided for the cartridge. The corresponding means are simple and practical. Thus the piston, which corresponds to the front, smaller cross section of the cartridge, is seated in an insertion region of larger cross section of the cartridge. Within this region an air-pervious contact between the piston sealing surface and the inner wall of the larger cross section end is present. In this way, the piston is prevented from sealing immediately at the start, which, depending on the amount of filling, could lead to a build-up of pressure on the ointment so that the latter would be displaced prematurely through the divergent wall openings—even if only to a slight extent. Furthermore, tightness in the rear region of the cartridge until initial use is obtained by a simple means in the manner that the end is closed by a membrane which can only be punctured intentionally by means of the piston rod of the application handle. In one structurally advantageous development, the air-pervious contact is formed by air spaces between ribs of the inner wall of the cartridge which extend in the direction of movement of the piston. The corresponding ribbing, which is arranged with equal angular distribution, leads at the same time to a stabilizing of this rear region of the cartridge. Due to the fact that the crest of the ribs furthermore is slightly set back with respect to the inner wall of the smaller cartridge cross section and the piston sealing surface is formed by sealing rings on the cap-shaped piston, a perceptible step is provided. The piston in this way can not shift as a result of its own weight. Upon the intentional displacement of the piston, the corresponding step, on the other hand, is overcome relatively easily. One advantageous embodiment, furthermore, is that the end of the piston rod which acts on the piston and centrally punctures the membrane is of frustoconical shape and enters, with form-interlocking engagement of the frustoconical wall surface of the piston rod, into a rear depression of the piston, the sealing rings of the piston being spaced in a direction opposite the direction of displacement of the piston to the point of contact of the frustoconical wall surface. This has the advantage that the forces which displace the piston act to center it. The piston, which can be made surprisingly short, cannot tilt. Due to the fact that the pushing contact takes place at the front section of the piston, the sealing part of the piston which bears the sealing rings is pulled along. In addition to this, the end of the piston rod which has entered into the depression provides a favorable stiffening of the tip of the piston. The latter, or even the entire piston, can therefore be made with an extremely thin wall. The corresponding saving of material has a very substantial effect in the case of a mass-produced article such as this. The ointment applicator and cartridge can be instantly brought into the position ready for use. For this purpose, an axially or radially directed annular groove/rib clip connection is provided between the rear collar of the cartridge and the front edge of the ointment applicator. The corresponding laterally open or complete annular grip-around exerts a stabilizing action on the zone of connection of the two parts; a band-like grip is present. Due to the further feature that the free end of the piston rod is guided in a central hub which terminates flush with the front edge of the applicator housing and continues in the same plane into the partially opened cover of said housing, a stable abutment for the cartridge is obtained by structurally simple means. It is furthermore advantageous for an annular space to be left between the piston and the piston rod for the entrance of the inwardly pushed perforated edge portion of the hole in the membrane resulting from puncturing the membrane by the piston rod. The perforated edges of the membrane in this way can not be clamped; rather, the piston and piston rod can be pushed easily forward. Furthermore, the corresponding annular space favors the self-correcting alignment of the piston and piston rod. A dispensing of the filling material without loss is obtained with simple means in the manner that the mouth end of the cartridge is shaped in a manner approximately corresponding to the shape of the tip of the piston. For hygienically covering the cartridge and for filling it, it is furthermore of advantage for at least the perforated region of the cartridge to be covered by a protective cap which tightly closes off the wall openings. Thus, for instance, nothing can emerge as a result of static pressure. Upon pushing on the protective cap, which is done before the filling, the displaced air of the cap can furthermore escape through the wall openings. For the subsequent removal of the protective cap it is then advantageous for the end of the protective cap to have an air equalization opening which can be closed by the free end of the cartridge. A sealing of this air equalization opening which is reliable in use is obtained simply by forming the free end of the cartridge as a semi-spherical dome, terminating the front edge of the protective cap at a slight distance in front of the top annular surface of the collar and holding the cap in a tight seat on the wall surface of the larger cross section end which is widened by offsetting the wall. Finally, the invention also proposes that the application handle be of tubular shape, with a completely closed tube wall extending over a short portion of its length and an operating plate of the piston rod disposed in the rear region where the tube wall extends only over slightly more than half the circumference, with the operating plate being arranged freely protruding laterally in part over the edges of the tube wall which define a longitudinal grip opening. In this way the operating plate can be easily reached. The corresponding gripping around by the tube wall furthermore provides an advantageously usable clip attachment for the operating plate. The basic position can thus be held in a detent position.

BRIEF DESCRIPTION OF THE DRAWING

The object of the invention is explained in further detail below with reference to an embodiment shown in the drawing by way of illustration, in which.

DETAILED DESCRIPTION OF THE PREFERRED EMBODIMENT

Figure 2:
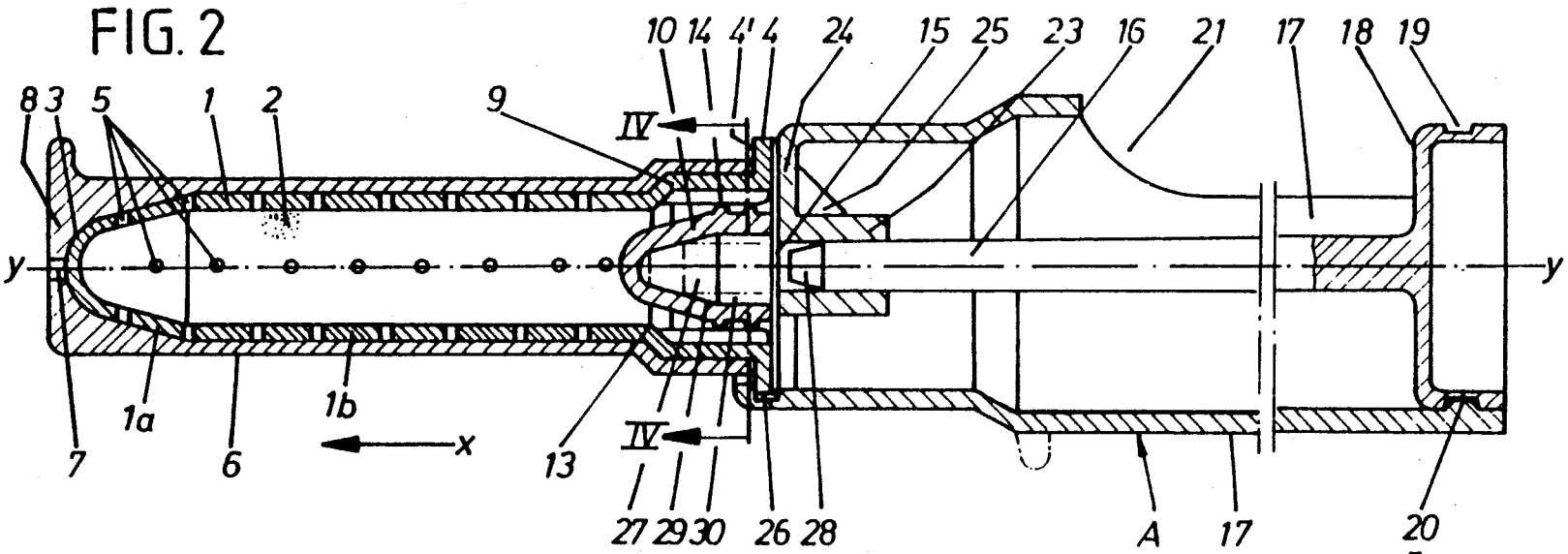
FIG. 2 is a longitudinal section through this unit shown on a larger scale.
Figure 3:
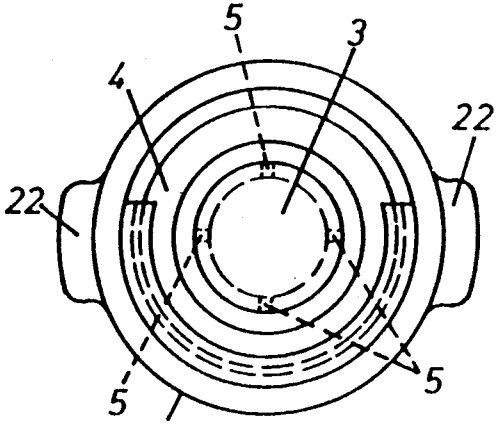
FIG. 3 is an end view of FIG. 2, seen from the cartridge end.

The packing container which is developed as a cylindrical cartridge 1 contains ointment 2 (a small portion of the contents being indicated by dots).

The insertion end of the cartridge is rounded so as to form a dome 3. The round section passes into a short frustoconical section 1*a* which adjoins the cylindrical section 1*b* of the cartridge. The rear end of the cartridge forms an outwardly directed collar 4.

The cartridge 1, which is hollow over its entire length, is provided with diverging wall openings 5. These openings are circular and lie in different planes with respect to the longitudinal direction. In the embodiment shown, four rows of holes aligned in longitudinal direction and located at the same angle from each other extend, commencing at a distance from the collar 4, to slightly in front of the dome 3. In order to make this situation clear, only a portion of the ointment 2 has been shown. The dome 3 itself is not perforated.

A protective cap 6 can be pushed-on and tightly seals the wall openings 5 in the condition of storage of the packing container. It is a cup-shaped cylindrical body which terminates in contact with the vertex of the dome. For application making contact between the dome 3 and the bottom 8 of the protective cap, which bottom has a central air equalization opening 7, the end edge of the protective cap terminates at a slight distance from the upper annular surface of the collar 4, i.e. the surface facing in the direction of the end of the cartridge.

Figure 4:
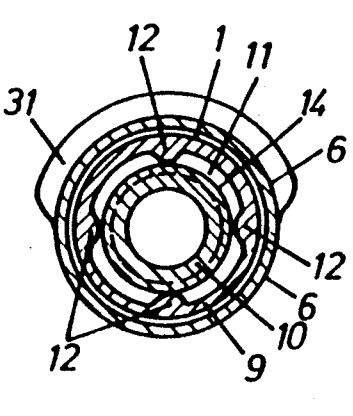
FIG. 4 is a section along the line IV—IV of FIG. 2.

The protective cap 6 is held in a tight fit on the cartridge 1. For this purpose, the section of the cartridge facing away from the dome 3 passes into a region 9 which has an increased cross section by a wall offset. This region 9 of larger cross section forms the insertion region for a piston 10 which corresponds in its dimensions to the smaller cross section of the front portions 3, 1*a* of the cartridge. The piston is located in air-pervious contact between its sealing surface 14 and the inner wall of this region 9 of larger cross section. The air-pervious contact is formed by free spaces 11 between ribs 12 on the inner wall of the region 9, the ribs extending in the direction of movement of the piston (arrow x). Reference is made to FIG. 4, from which this situation is clear.

The crest of the ribs 12, which are arranged at equal angles apart and serve to guide the piston, is slightly set back as compared with the inner wall of the smaller cross section of the cylindrical section 1*b* of the cartridge so that a small step 13, which can be noted in FIG. 2, is present in the zone of transition between the widened cross sectional region and the reduced cross sectional region. Said step forms a stop for the inserted piston 10 which can pushed intentionally beyond the stop.

The scaling surface of the piston 10 consists of two sealing rings 14 which extend parallel to each other and are perpendicular to the direction of movement x of the piston, said sealing rings being formed directly on the piston 10.

The cartridge 1, which is filled with ointment and then provided with the piston, is sealed. A membrane 15 serves as a sealing means. This membrane, which surrounds the rear end of the bottom of the cartridge and corresponds in dimensions to it, can be punctured by actuation of a piston rod 16 of an application handle A.

The application handle A consists of a cylindrical housing 17 which receives the piston rod 16 centrally. The piston rod extends towards the outside into an operating plate 18. The initial position of the piston rod 16 is detented. For this purpose, the operating plate 18 has an annular groove 19 on its circular outer wall. A detent projection 20 on the housing 2 engages into said groove, or vice versa.

Figure 1:
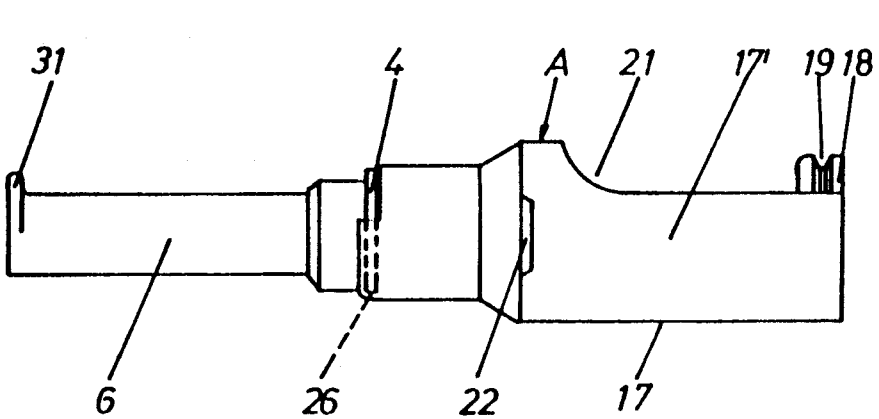
FIG. 1 shows an ointment cartridge detachably associated with an ointment applicator, seen in side view in approximately actual size.

For the displacement of the piston rod 16, the operator extends his thumb through a lateral, longitudinally directed gripping opening 21 of the housing 17 while his index and middle fingers rest on wings 22 provided on the housing. The wings 22 are in the region of the zone of connection between the application handle A and the cartridge 1. They extend radially, starting from the tubular wall of the housing, namely diametrically opposite each other. The gripping opening 21 extends up into the vicinity of this zone of connection. The cut which produces the gripping opening 21 leaves a residual wall whose edges 17' extend on their predominant longitudinal section only slightly more than over half the circumference of the operating plate 18. The operating plate is in this way sufficiently guided and can be clipped into position from the side in practice. The piston rod guidance in the cartridge-side end region of the housing 17 is furthermore formed by a central hub or sleeve 23 formed by an axially inwardly drawing of the cover 24 of the housing. The cover 24 forms essentially the front section of the housing 17. It is partially interrupted. Furthermore, a supporting rib 25 which fills the inner corner towards the cover extends from the cylindrical wall of the sleeve 23. The supporting rib 25 extends radially and several of them can be provided. The outside of the cover 24 is an abutment for the cartridge which is sealed on its end side. Starting from the cover 24, the housing forms an insertion slot 26 which receives the collar 4 in form-interlocked manner and is open on a transverse side therefor. The slot-forming section is in this case also cut away somewhat less than one-half (see FIG. 1). The width of the slot corresponds to the axial thickness of the collar 4 so that in addition to radially securing the collar 4 there is also provided a stable axial fixing of the collar including the membrane 15 which serves at the same time as a tension cushion. The overlapping flank of the insertion slot has a backward cut so that the inserted protective cap 6 is also still surrounded at its end. With an axially oriented clip attachment, the edge flank would have an outwardly open insertion funnel whose wall could be slit repeatedly in axial direction in order to facilitate the insertion.

The cartridge-side end 28 of the piston rod 16, which is otherwise cylindrical, is of frustoconical shape. The cup-shaped piston 10 has a depression 27 which corresponds to the cone inclination, so that the frustoconical wall surface 28 of the piston rod end comes in form-interlocked contact axially aligned against the corresponding funnel-shaped inner surface 29 of the piston 10. The piston rings 14 which provide the piston sealing surface extend, on the other hand, clearly rearwardly spaced. The piston 10 is thus, pulled along, which promotes a completely tilt-free guidance.

Between the piston 10 and the piston rod 16 an annular space 30 remains. This can be noted from FIG. 2. The advanced position of the piston rod can be noted from the dot-dash lines. The edge portions of the hole is torn open upon the puncturing of the membrane 15 which are pushed into this annular space 30. They do not enter into a clamping position with respect to the piston. The axial length of the depression 27 is greater than the inside diameter of the piston.

As can furthermore be noted from FIG. 2, the mouth end or dome 3 with the adjoining frustoconical section 1*a* has a shape which corresponds to the shape of the rounded point of the piston 10. In this way, the content is dispensed substantially completely without any residue.

For removing the protective cap, the cap has a transversely directed grip protrusion 31 in the region of its bottom 8.

The operation is as follows: The full cartridge 1, whose hallow filling space is closed by the membrane 15 which extends at the rear of the piston, is transversely locked to the application handle. The protective cap is then pulled off. This is facilitated by the air equalization opening 7; furthermore, no ointment is drawn out through the openings 5 in the wall. By pressing on the operating plate 18, which is effected while overcoming the small detent there between annular groove 19 and the detent projection 20, the piston rod 16 can be moved axially in the direction of the arrow x, the rod 16 extending in the longitudinal central axis y—y of the cartridge. The piston rod approaches the membrane 15. The latter is punctured. The edges of the hole disappear within the annular space 30 of the piston depression 27. The displacement of the piston which now takes place brings the filling material to the target place. For the detachment of the cartridge, the protective cap 6 can again be placed on so that the operator does not come into contact with the remaining ointment. The air equalization opening 7 permits the emergence of the displaced air in front of the point of the cartridge.

The preassembling of the cartridge is effected as follows: It is first of all filled. The protective cap which is placed on avoids the emergence of ointment through the openings 5; the air equalization opening is kept closed by the dome 3. The piston 10 is then mounted. The displaced air escapes via the free spaces 11. Sealing is then effected by means of the membrane 15. The sealing may be hot scaling or else a simple gluing.

I claim:

1. An ointment applicator with a packing container which contains ointment and can be emptied by pressure actuation, comprising an application handle, a packing container shaped as a cartridge having diverging wall openings, and a rear end having a collar insertable in said application handle, and defining adjacent the rear end an insertion region of enlarged cross section, said cartridge having a front having a reduced cross-section, said insertion region of the cartridge having an inner wall, a moveable piston corresponding to the reduced cross-section of the front of the cartridge being insertable in said insertion region, said piston having a sealing surface defining an air-pervious contact between said sealing surface and said inner wall of said insertion region of said cartridge, a membrane closes an end of said insertion region of said cartridge, and said application handle includes a movable piston rod comprising means for piercing said membrane and moving said piston in said cartridge.

2. The ointment applicator according to claim 1, wherein said inner wall of the cartridge has ribs extending in a direction of movement of the piston in said cartridge, said ribs defining said air-pervious contact by free spaces between said ribs.

3. The ointment applicator according to claim 2, wherein said ribs have crests radially outwardly set back slightly from a cartridge interior wall having a smaller cartridge cross-section than and adjacent said insertion region, and said sealing surface of said piston includes sealing rings engaging said ribs.

4. The ointment applicator according to claim 3, wherein said piston defines a rear recess, said piston rod has a piston rod end which moves said piston and centrally punctures the membrane and has a frustoconical surface, said piston rod end enters with form-interlocking engagement of said frustoconical surface, into said rear recess of the piston such that said sealing rings of the sealing surface of said piston are located, in a direction opposite the direction of movement of the piston in said cartridge, spaced from the place of engagement of the frustoconical wall surface with said piston.

5. The ointment applicator according to claim 4, wherein said rear recess defines, between the piston and the piston rod when the latter has entered said rear recess, an annular space for entrance therein of an edge portion of a hole in the membrane which has been pushed by said piston after the latter pierced the membrane.

6. The ointment applicator according to claim 1, further comprising a radially directed annular-groove/rib clip connection between said collar of said cartridge and a front edge of said application handle.

7. The ointment applicator according to claim 1, wherein said application handle has a housing and a central hub which terminates flush with a front edge of said application housing and extends in a same plane as and into a partially opened cover of said housing thereat, a free end of the piston rod is guided in said central hub.

8. The ointment applicator according to claim 1, wherein said front of the cartridge constituting a free end thereof is shaped approximately corresponding to the shape of a point of said piston, and said cartridge has a perforated region comprising said wall openings, a protective cap grips over at least said perforated region of said cartridge tightly closing said wall openings of said cartridge.

9. The ointment applicator according to claim 8, wherein said protective cap has one end formed with an air equalization opening which is closable by said free end of said cartridge.

10. The ointment applicator according to claim 9, wherein said front of the cartridge constituting said free end thereof is shaped as a semispherical dome, the other end of the protective cap terminates a slight distance in front of an annular surface of said collar, said cap being held in a tight fit on an outer surface of said insertion region of enlarged cross-section of the cartridge, said enlarged cross-section being widened by a walling off-setting of said cartridge.

11. The ointment applicator according to claim 1, wherein said application handle is of tubular shape having a tube wall which is a completely closed tube extending only over a relatively short length of said application handle, said application handle includes an operating plate connected to said piston rod and movably disposed in a rear region of said application handle, said tube wall extends only over slightly more than half of the circumference of said operating plate at said rear region of said application handle, said operating plate being arranged protruding freely laterally partly over edges of the tube wall of said rear region of said application handle, said edges defining an elongated gripping opening.

12. The ointment applicator according to claim 1, further comprising an axially directed annular-groove/rib clip connection between said collar of said cartridge and a front edge of said application handle.

* * * * *